US012583568B2

(12) United States Patent
Hull

(10) Patent No.: US 12,583,568 B2
(45) Date of Patent: Mar. 24, 2026

(54) JACK PLATE

(71) Applicant: Tyler B. Hull, Wilmington, NC (US)

(72) Inventor: Tyler B. Hull, Wilmington, NC (US)

( * ) Notice: Subject to any disclaimer, the term of this patent is extended or adjusted under 35 U.S.C. 154(b) by 0 days.

(21) Appl. No.: 18/791,546

(22) Filed: Aug. 1, 2024

(65) Prior Publication Data

US 2025/0042523 A1 Feb. 6, 2025

Related U.S. Application Data

(60) Provisional application No. 63/517,252, filed on Aug. 2, 2023.

(51) Int. Cl.
*B63H 20/10* (2006.01)

(52) U.S. Cl.
CPC ..... *B63H 20/10* (2013.01)

(58) Field of Classification Search
CPC ..... B63H 20/10
USPC ..... 248/640
See application file for complete search history.

(56) References Cited

U.S. PATENT DOCUMENTS 4,232,627 A * 11/1980 Glenn ..... B63H 20/106 248/641
5,484,311 A * 1/1996 Detwiler ..... B63H 20/106 248/641
5,782,662 A 7/1998 Icenogle
6,305,996 B1 10/2001 Detwiller
8,267,025 B2 * 9/2012 Witte ..... B63H 20/106 248/641
9,598,159 B2 * 3/2017 Nyren ..... B63H 20/06

* cited by examiner

*Primary Examiner* — Anita M King
(74) *Attorney, Agent, or Firm* — Russell D. Nugent; Comprising IP

(57) ABSTRACT

A jack plate with a single solid engine plate and a single solid transom plate. The transom plate features one or more sleeves integrated therein. The engine plate is connected to one or more sleeve rods that insert into the sleeves when the engine plate is lowered with respect to the transom plate. The sleeves each feature a narrow backwards facing slot through which the engine plate connects to each sleeve rods. Each sleeve rod is equipped with a linear bearing and a proprietary material that reduces friction. Only a single end of each sleeve rod is connected to the jack plate. The other, free end, of each sleeve rod passes through a first and a second end of the sleeve into which it is inserted. The configuration of the sleeves, sleeve rods and plates allows the device to be shorter, thinner and narrower thereby taking up less space.

10 Claims, 4 Drawing Sheets

JACK PLATE

CROSS-REFERENCE TO RELATED APPLICATIONS

This application claims the benefit of priority to U.S. Provisional Application No. 63/517,252 filed on Aug. 2, 2023. The content of U.S. Provisional Application No. 63/517,252 filed on Aug. 2, 2023 is incorporated by reference in its entirety.

BACKGROUND OF THE INVENTION

(a) Field of the Invention

The present invention is in the technical field of marine accessories. More particularly, the present disclosure relates to a novel jack plate for use in attaching a motor to another surface, such as a marine vessel.

(b) Background Art

A jack plate is a device used to connect a motor to a marine vessel such that the position of the motor can be adjusted without taking the motor off the vessel. These devices are typically mounted on the vessel in between the motor and the transom of the hull of the boat. The means by which they adjust the position of the motor varies from one device to another. U.S. Pat. No. 5,782,662 issued to Robert O. Icenogle illustrates a typical jack plate. Icenogle discloses a jack plate that has a support shaped like a bracket, including open-faced channels or grooves in which the slide slides or moves up and down. A hydraulic cylinder also connects the support and the slide such that the hydraulic cylinder moves the slide up and down in relation to the support that is connected to the transom. The engagement of the slide using open-faced channels causes the device to take up more room laterally than it would otherwise. In addition, the functioning of this device can be affected when debris and dirt enter the open-faced channels through which the slide moves up and down.

Similarly, U.S. Pat. No. 6,305,996 issued to Timothy Detwiler has a jack plate that consists of two plates that slide against each other and are engaged in a slot on the side of one portion of the jack plate. This arrangement also takes up a larger footprint than the currently disclosed device and the slot in which a portion of the jack plate slides can become contaminated with dirt and debris making it less functional.

The inventor has decreased the amount of space needed to mount the jack plate by moving the sliding means, the structures that allow the two portions of the jack plate to move relative to one another, inboard toward the center of the jack plate to (1) increase the strength of the device and (2) reduce the footprint of the device. In addition, mounting the attached sliding and bearing components directly to two solid plates (engine and transom), increases the structural rigidity of the entire apparatus.

BRIEF SUMMARY OF THE INVENTION

As discussed above, current jack plates typically have a set of brackets that slide in grooves that are on a complementary bracket so that when force is applied to one set of brackets, the two sets of brackets slide in relation to each other causing the position of the motor to change as desired by the user. The sliding mechanisms tend to be outboard of the center of the device, i.e. towards the outer edges of the device. In addition, the grooves in which the plates slide relative to one another tend to be open faced grooves or slots. Moreover, prior art jack plates tend to use a collection of parts that are assembled into a transom or engine plate rather than using solid, one-piece plates as disclosed in preferred embodiments of the disclosed device.

The inventive jack plate disclosed herein has a sleeve rod the outer surface of which is enclosed in a sleeve when the engine plate is in a fully lowered position. The sleeve rod fits into and moves within this sleeve which encircles the exterior of the rod thereby providing considerably more support. In preferred, embodiments, the transom plate includes the sleeve into which and through which the sleeve rod passes. The sleeves include a backwards facing one-half inch wide slot through which the sleeve rods are connected to the engine plate. This configuration allows the device to have a smaller setback than other devices.

In some embodiments, the sleeve and sleeve rod are not located at the edges of the device, but have been brought inboard, closer to the center of the device. This configuration allows for a smaller footprint, i.e. the device takes up less space laterally on the back of the marine vessel. In other embodiments, meant to be used with larger engines, the sleeve rods will need to be larger and may need to be located closer to the edges of the jack plate.

In addition, the inventive jack plate uses solid, one-piece transom and engine plates. This arrangement minimizes the propensity for the plates to "flex" or bend and decreases the number of parts that are capable of movement or detachment thereby making the device stronger.

Furthermore, the design of the inventive jack plate causes the jack plate to have shorter collapsed height than other devices on the market. More specifically, prior art devices such as the Seastar Sierra JP5080X Jackplate have rods that are connected to the engine plate at both ends. The hydraulic cylinder moves the engine plate up and down along the length of these two rods and as a result, the height of the device is dictated in large part by the length of the rods. The inventive jack plate disclosed herein does not have a connection to either the transom or the engine plate at both ends of the sleeve rods, but rather the top end of the sleeve rods is connected to the engine plate and the bottoms of each sleeve rod are not connected to either plate. Rather, the bottom portions of the sleeve rods in this design are free to move in and out of the sleeves through which the sleeve rods pass. This configuration allows the height or length of the sleeve rods to be equal to the length of the linear bearing inside each sleeve, thereby maintaining a shorter overall height while allowing for a longer bearing.

The presently disclosed device contains one or more of the following features. The device includes at least one plate attached to the transom of a marine vessel (the transom plate) and at least one additional plate that is attached to the motor itself (the engine plate). A hydraulic cylinder or some other means of moving the two plates relative to each other is also included in the device. The hydraulic cylinder is fixed or attached to one of the plates at a first end and the other plate at a second end such that when the cylinder is activated, it pushes the second end of the cylinder away from the first end and thereby causing the structure to which the second end is attached to move away from the structure to which the first end of the cylinder is attached.

Preferred embodiments of the device contain at least one sleeve—a structure that encloses a space through which a sleeve rod moves in conjunction with the movement of the plate(s). The sleeve(s) are attached to one of the plates and the sleeve rod(s) are attached to the opposing plate. When one plate moves relative to the other, the sleeve rod moves within the sleeve. In preferred embodiments of the device, the sleeve rods are attached at a first end to the engine plate such that the movement of the engine plate relative to the transom plate causes the sleeve rods to slide up and down within a chamber defined by each of the sleeves. Because the sleeve completely encloses or surrounds the outer surface of the sleeve rod when it is inserted fully therein—there is less opportunity for dirt, water and other debris to enter the sleeves and thereby compromise the movement of the rods with the sleeves. When the engine plate is raised with respect to the transom plate by the action of the hydraulic cylinders, the portion of the sleeve rod attached to the engine plate moves out of the sleeve.

The inside of the sleeve is equipped with a linear bearing that reduces the fiction associated with the movement of the sleeve rod. Preferred embodiments of the device include a linear bearing positioned to line the interior of each sleeve. Some prior art designs use two small bearings with each rod, the inventive jack plate disclosed herein uses linear bearings that provide longitudinal support over much larger surface area of the sleeve rod as it moves through the sleeve. In addition, the linear bearings are constructed out of a proprietary material called KryptoQuiet™ that also reduces friction and does not require lubrication. The KryptoQuiet material works particularly well in marine environments where equipment will be exposed to salt water. This material has been shown to leave or deposit a film on the rod(s) as they move through the sleeve while in contact with the linear bearing. This deposit further decreases friction between the interior surface of the sleeve(s) and the exterior surface of the rod(s). Other bearing materials may be substituted as technology evolves or needs/requirements change.

The prior art devices typically have brackets attached to each other via some form of groove or channel located proximate to the outer edges of the jack plate. However, the inventor has discovered that by eliminating open-faced grooves or channels and using sleeves that enclose the outer surface of the sleeve rod, the device not only takes up less space, but is considerably more stable. Moreover, it decreases the amount of material needed for constructing the jack plate, effectively decreases the weight of the device and decreases the manufacturing costs. These and other advantages will be apparent to a skilled artisan upon reading the detailed description below.

DETAILED DESCRIPTION OF THE INVENTION

Figure 1:
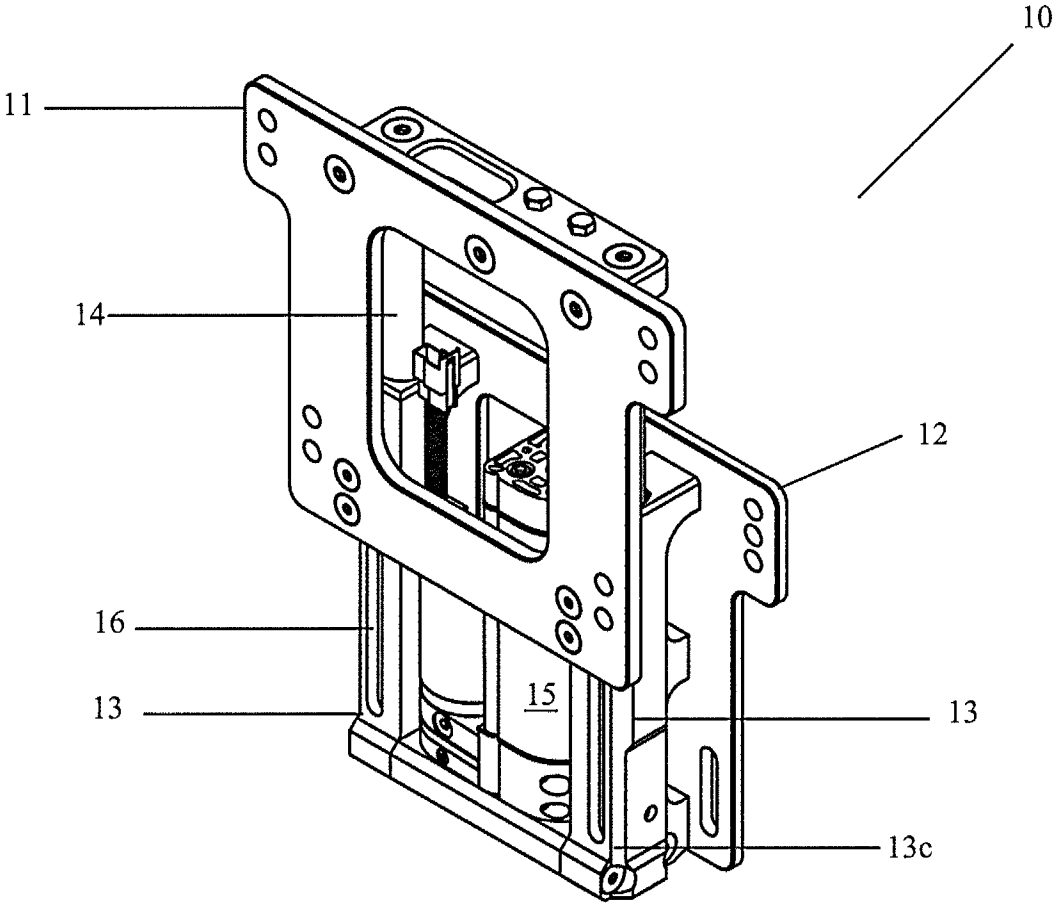
FIG. 1 is a rear perspective view of a preferred embodiment of the jack plate.
Figure 2B:
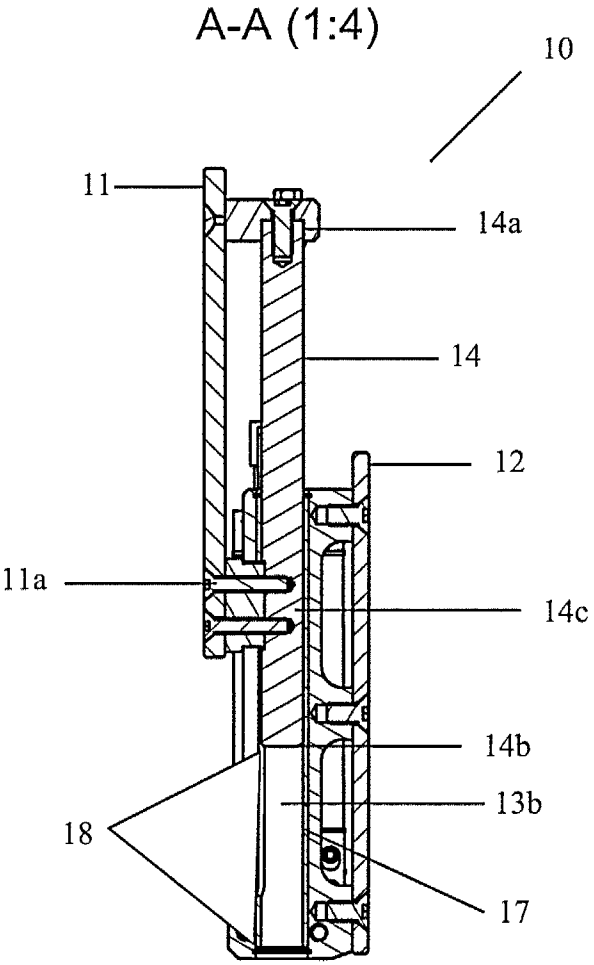
FIG. 2B is a cross-sectional view thereof cut along the line labeled as A in FIG. 2A.
Figure 2A:
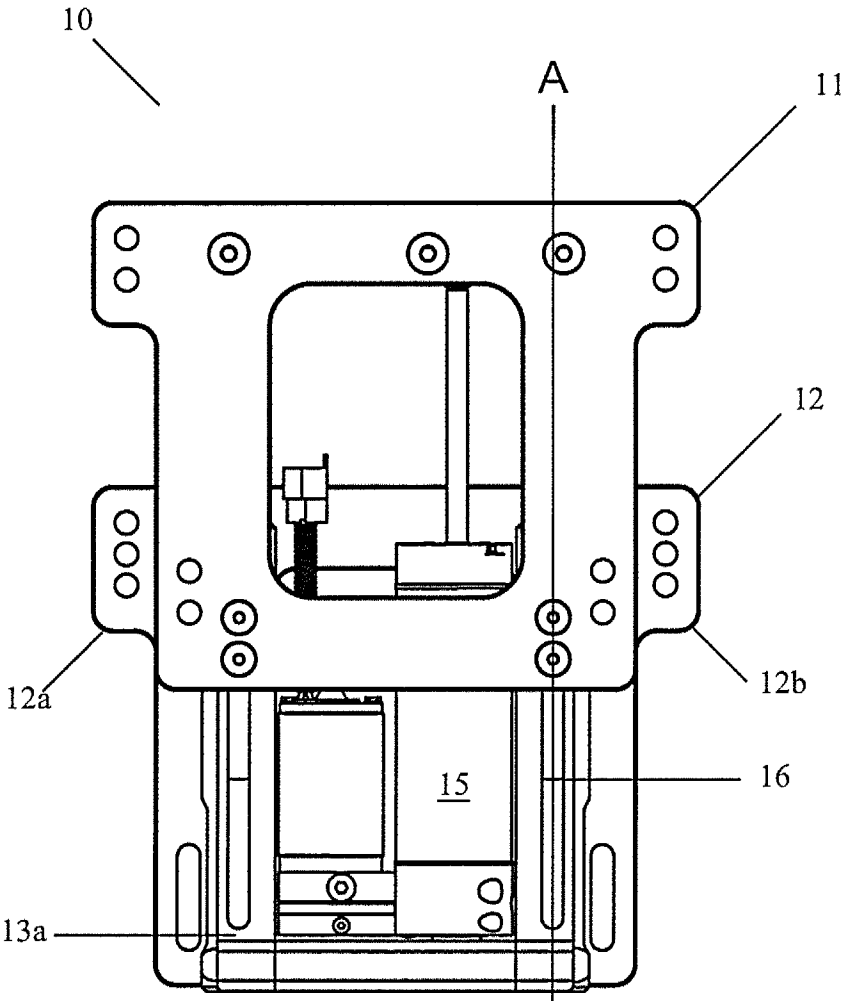
FIG. 2A is a rear plan view thereof.

Referring now to the invention in more detail, FIGS. 1 and 2A show the inventive jack plate 10 from the rear, i.e. with the engine plate 11 being closer to the viewer than the transom plate 12. As discussed above, the transom plate 12 includes or features one or more sleeves 13 integrated into the plate 12. In this case there are two sleeves 13 positioned between the transom 12 and engine plates 11. One plate, in this embodiment, the engine plate 11, is attached to a first end 14*a* of each of the sleeve rods 14 while a second end 14*b* of each of the sleeve rods 14 is free to move within their respective sleeve 13. When the engine plate 11 and transom plate 12 are moving with respect to each other via the action of the hydraulic cylinder 15 or other means, the sleeve rods 14 insert into and withdraw from the sleeves 13. In preferred embodiments of the jack plate 10, the sleeve rods 14 insert and pass through the sleeves 13 such that when the engine plate 11 is in its fully lowered position, the lower ends 14*b* of the sleeve rods 14 protrude slightly from the sleeves 13 (see FIG. 4). Because the first end 14*a* of each rod 14 is attached to the engine plate 11, and the second end 14*b* is not so attached, the engine plate 11 is able to move higher with respect to the rest of the device, i.e. if the engine plate 11 were also attached to the second end 14*b* of each sleeve rod 14, then the movement of that plate would be stopped by the connection between the second end of the rod 14 and the engine plate 11. The free end 14*b* of each sleeve rod 14 can move up and into the lower end (second end 13*c*) of the sleeve 13 into which it is inserted thereby allowing the engine plate 11 more upward movement with respect to the transom plate 12.

This is a critical feature of the device. Prior art devices that use sleeve rods limit the movement of the plate that slides along the sleeve rods by attaching each sleeve rod at the top and bottom to one of the plates. That prevents the plate that is moving along the length of the sleeve rods from moving past the points where the rods are connected to the plate. The presently disclosed device uses sleeve rods that have a free end that is not attached to either plate thereby providing more range of movement with a shorter set of sleeve rods.

Figure 3:
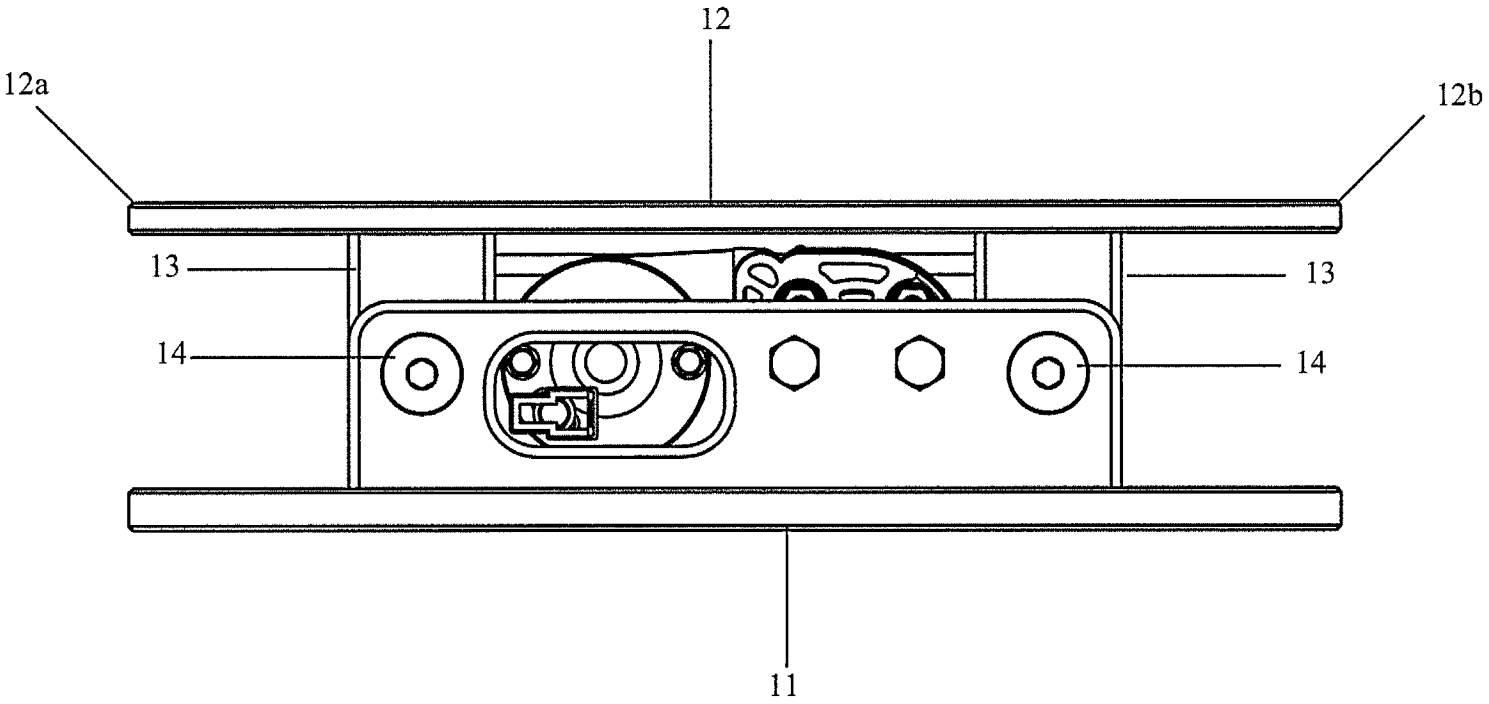
FIG. 3 is a top view thereof.

As shown in FIGS. 1-3, the inventive jack plate 10 uses sleeves 13 that enclose and/or encircle the outer surface of the portions of the sleeve rods 14 inserted therein, thereby providing physical support to the rod in almost 360 degrees (the slot 16 discussed below prevents the complete enclosure of the sleeve rods). The device does not use channels that guide the plates when moving up and down like a lot of other prior art devices, but rather a cylindrical sleeve rod 14 that is enclosed in the sleeve 13.

FIGS. 1 and 2A also show the backwards facing slot 16 on the sleeve 13. As discussed above, in preferred embodiments, the sleeves 13 are integrated into or otherwise attached to the transom plate 12. Each sleeve encloses a chamber 18 that is open at both ends. Each sleeve 13 can also feature a narrow slot 16 that runs over a portion of the length of the sleeve 13. This slot 16 traverses the sleeve 13 from an exterior surface 13*a* to an interior surface 13*b* of said sleeve 13. In some embodiments, the engine plate 11 directly connects to each sleeve rod 14 through these slots 16 via a protrusion 11*a* that extends away from a surface of the engine plate 11 through the slot 16 to connect to an intermediate section 14*c* of the sleeve rod 14 that is between the first end 14*a* and the second, free end 14*b* of the rod 14. While this connection is optional, it increases the overall strength of the device. This configuration also allows the device to be smaller and to "sit back" less or take up less room between the transom and the engine of a vessel. In addition, it allows for smoother movement between the transom and engine plates as there are less pieces and parts that need to move. This configuration also makes the plate less likely to produce unwanted movement, i.e. binding or "walking" during use. In contrast, some prior art devices have transom plates that include a sleeve that encircles a portion of the sleeve rod and moves along the length of a sleeve rod that is attached at both ends to the engine plate. Because both ends of the rods are attached to the engine plate, the engine plate cannot move up or down past the point at which they connect to the rods. As a result, the device requires a larger engine plate and longer sleeve rods to affect the same amount of movement of this device.

FIG. 2B shows a cross-sectional side view thereof cut along the line labeled as "A" in FIG. 2A. The cross section is cut through one of the sleeves 13 to show the chamber 18 that includes the linear bearing 17. As discussed above, the linear bearing is composed of a proprietary material designed for use in saltwater and does not require lubrication or maintenance. This material facilitates the movement of the sleeve rods 14 into and out of the sleeves 13 when the jack plate 10 is in use. It also supports the rod 14 over the full length of the rod that is presently engaged at a given time. Moreover, this material has been shown to deposit a film of the material onto the surface of a device that slides against the material, i.e., as the sleeve rod 14 slides through the chamber 18, a small amount of the material lining the interior surface of the chamber 18 of the sleeve 13 gets deposited onto an exterior surface of the rod 14, thereby facilitating the movement of the rod and reducing friction.

FIGS. 1, 2A and 2B also show that each of the engine plate 11 and the transom plate 12 are solid plates rather than structures made of several different parts like a lot of prior art devices. This arrangement makes the device much stronger and deceases the amount of flexing or bending the occurs when the device is in use.

Figure 4:
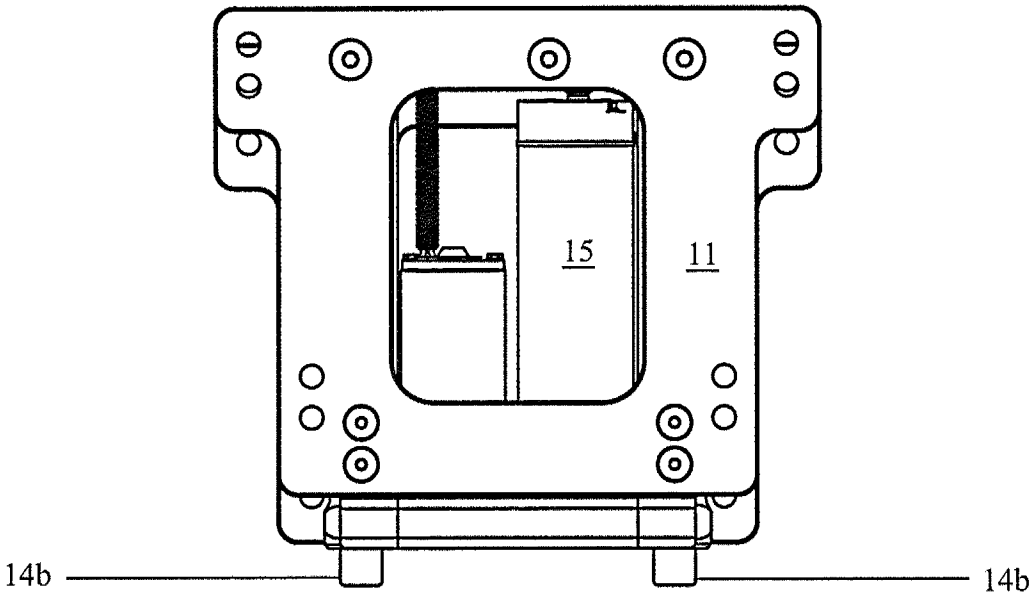
FIG. 4 is a rear plan view of the device showing the engine plate in a lowered position.

FIG. 3 shows a top view of the same embodiment of the jack plate 10. FIG. 3 shows that the sleeve rods 14 in this embodiment are located inboard of the edges of both the engine plate 11 and the jack plate 10. In other words, the location of the sleeves 13 and sleeve rods 14 is inside the outer edges of the device 10, i.e. the sleeves 13 are recessed with respect to a right side 12*a* and a left side 12*b* of the transom plate. This allows the device to take up less room. FIG. 4 shows another rear perspective view of a preferred embodiment of the device 10. In this figure, the engine plate 11 is in its fully lowered position.

FIG. 4 shows that when the engine plate 11 is in this lowered position, in this embodiment, the sleeve rods 14 extend out past the lower open ends of the sleeves 13. As discussed above, the configuration of the sleeves 13 and sleeve rods 14 allows the device 10 to take up less space in three dimensions. Since neither plate is mounted to both the top and bottom of the sleeve rods 14, the device is shorter.

A skilled artisan could appreciate that this device could be used in other contexts besides marine vessels such as land-based vehicles or any other situation in which a large object, such as an outboard motor, needs to be attached to a larger object such that its height and/or position can be modified without removal of the large object.

The advantages of the presently disclosed jack plate are numerous. The bearing and sleeve configuration allow the device to be shorter, narrower and thinner, i.e. to have a smaller setback from the vessel. The jack plate requires less materials to construct and is physically more stable and stronger than prior art devices. In addition, the use of full plates as opposed to brackets reduces the tendency of the jack plate to flex or bend. By enclosing the sleeve rods in sleeves, with the exception of the portion that faces the narrow slot, the inventor has created a jack plate that is not only structurally stronger, but also has the added bonus of preventing dirt and debris from fouling the sleeve or sleeve rods.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above-described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

I claim:

1. A jack plate comprising:

a transom plate with at least one sleeve;

an engine plate;

at least one rod with a first end attached to the engine plate and second, free end that freely slides through a portion of the sleeve when the engine plate is moved up or down; and at least one protrusion extending away from a surface of the engine plate, into a slot cut into the at least one sleeve wherein the at least one protrusion attaches to the at least one rod in between the first end and the second ends.

2. The jack plate of claim 1, further comprising a linear bearing lining the interior of each sleeve.

3. The jack plate of claim 2, wherein the linear bearing is made of a material that is deposited on the two rods as they slide in and out of the sleeves.

4. The jack plate of claim 3 wherein the at least one sleeve is recessed with respect to a right side and a left side of the transom plate.

5. The jack plate of claim 1 wherein the at least one sleeve is recessed with respect to a right side and a left side of the transom plate.

6. A jack plate comprising:

a first plate and a second plate;

a plurality of sleeves, each of the plurality of sleeves including an enclosed chamber that runs the entire length of each of the plurality of sleeves;

at least one slot cut into each of the plurality of sleeves; said at least one slot communicating with an interior of the enclosed chamber of each sleeve;

a plurality of sleeve rods that are sized and shaped to be removably inserted into the plurality of sleeves;

wherein the sleeve rods are attached to the second plate at a first end such that a second end of each of the plurality of sleeve rods is positioned to pass through the chamber of each of the plurality of sleeves.

7. The jack plate of claim 6 further comprising a protrusion that extends away from a surface of the second plate, through the at least one slot cut into each of the plurality of sleeves; wherein said protrusion connects the second plate to a portion of each of the plurality of sleeve rods that is between the first end and the second end.

8. The jack plate of claim 7 wherein the plurality of sleeves is recessed with respect to a right side and a left side of the first plate.

9. A jack plate comprising:

an engine plate;

a transom plate;

two sleeve rods each with a first end, a second end and an intermediate section that connects the first end and the second end;

two sleeves each with a first end and a second end and a chamber running the length of the interior surface of each of the two sleeves;

at least one slot cut into each of the two sleeves; said slot communicating with an interior of the enclosed chamber of each of the two sleeves;

a linear bearing inserted into each of the two sleeves; and wherein each of the two sleeve rods is positioned to slide inside the chamber of one of the two sleeves; and wherein each of the two sleeve rods is attached to the engine plate at their respective first ends; and the second end of each of the two sleeve rods are free in that they are not connected to either plate.

10. The jack plate of claim 9 wherein the linear bearing is made of a material that deposits a film on the two rods as they slide in and out of the sleeves.

* * * * *